US011341859B1

(12) United States Patent
Shepherd et al.

(10) Patent No.: US 11,341,859 B1
(45) Date of Patent: May 24, 2022

(54) MULTIPLE-CLIENT UNMANNED AIRCRAFT MANAGEMENT STATION

(71) Applicant: Rockwell Collins, Inc., Cedar Rapids, IA (US)

(72) Inventors: Karl L. Shepherd, Cedar Rapids, IA (US); Jason A. Myren, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 194 days.

(21) Appl. No.: 16/014,798

(22) Filed: Jun. 21, 2018

(51) Int. Cl.
*G08G 5/00* (2006.01)

(52) U.S. Cl.
CPC ..... *G08G 5/0043* (2013.01); *G08G 5/0013* (2013.01); *G08G 5/0026* (2013.01)

(58) Field of Classification Search
CPC ... G08G 5/0043; G08G 5/0013; G08G 5/0026
See application file for complete search history.

(56) References Cited

U.S. PATENT DOCUMENTS 6,522,867 B1 * 2/2003 Wright ..... G08G 5/0021 455/66.1
8,249,586 B2 * 8/2012 Bosenbecker ..... H04W 60/04 455/431
9,882,630 B2 * 1/2018 Jalali ..... H04B 7/18502
9,889,868 B2 * 2/2018 Kim ..... B61L 27/0005
2006/0178141 A1 * 8/2006 McGuffin ..... H04B 7/18506 455/431
2007/0264953 A1 * 11/2007 Srinivasan ..... H04L 67/325 455/186.1
2007/0275659 A1 * 11/2007 Parkman ..... H04B 7/18506 455/13.4
2008/0144617 A1 * 6/2008 Molsberry ..... H04B 7/18506 370/389
2009/0073912 A1 * 3/2009 Bauchot ..... H04L 12/1854 370/312
2009/0103452 A1 * 4/2009 Horvath ..... H04B 7/18584 370/254
2009/0186611 A1 * 7/2009 Stiles ..... H04B 7/18506 455/431

(Continued)

*Primary Examiner* — Yazan A Soofi
*Assistant Examiner* — Naeem Taslim Alam
(74) *Attorney, Agent, or Firm* — Suiter Swantz pc llo

(57) ABSTRACT

A station for monitoring and managing multiple unmanned aircraft includes a data radio for receiving status data from one or more unmanned aircraft currently under the control of that station (and for sending command and control messages thereto). Each controlled aircraft is assigned processing resources including a high assurance router for identifying flight-critical status data (FCSD) and forwarding said FCSD to the aircraft manager dedicated to that aircraft. The aircraft manager generates status updates for its assigned aircraft based on the FCSD. Each station has a display manager for synchronizing status updates from the aircraft managers of all controlled aircraft and managing a priority queue of the controlled aircraft such that selected aircraft, e.g., early-connecting or warning-condition, are given highest priority. A display unit updates the synchronized status of each controlled aircraft; flight displays of a high priority aircraft may be shown, with summary windows for secondary aircraft.

16 Claims, 7 Drawing Sheets

(56) References Cited

U.S. PATENT DOCUMENTS

| | | | | |
|---|---|---|---|---|
| 2012/0143482 | A1* | 6/2012 | Goossen | G08G 5/0034 701/120 |
| 2012/0177061 | A1* | 7/2012 | Stahlin | H04L 67/12 370/467 |
| 2012/0270531 | A1* | 10/2012 | Wright | G08G 5/065 455/419 |
| 2014/0233099 | A1* | 8/2014 | Stark | G09F 21/14 359/446 |
| 2014/0249693 | A1* | 9/2014 | Stark | B64D 47/02 701/2 |
| 2015/0321768 | A1* | 11/2015 | Kumar | G08B 13/19695 340/870.07 |
| 2015/0339932 | A1* | 11/2015 | Ramanna | G08G 5/0039 701/528 |
| 2016/0155339 | A1* | 6/2016 | Saad | H04L 69/18 701/25 |
| 2017/0242431 | A1* | 8/2017 | Dowlatkhah | G08G 5/0069 |
| 2017/0357273 | A1* | 12/2017 | Michini | G05D 1/106 |
| 2018/0025557 | A1* | 1/2018 | Steinert | G07C 5/0808 701/99 |
| 2018/0061249 | A1* | 3/2018 | Cui | G08G 5/0013 |
| 2018/0197350 | A1* | 7/2018 | Kim | G05B 23/0254 |
| 2018/0205446 | A1* | 7/2018 | Dowlatkhah | G01S 17/42 |
| 2018/0375568 | A1* | 12/2018 | De Rosa | H04W 72/082 |
| 2019/0103952 | A1* | 4/2019 | Goudal | H04W 72/1242 |
| 2019/0174149 | A1* | 6/2019 | Zhang | H04N 21/21805 |
| 2020/0186237 | A1* | 6/2020 | Karlsson | H04W 84/06 |

* cited by examiner

MULTIPLE-CLIENT UNMANNED AIRCRAFT MANAGEMENT STATION

BACKGROUND

Unmanned aircraft (e.g., unmanned aircraft systems (UAS), unmanned aerial vehicles (UAV)) are conventionally monitored and managed via aircraft control stations operating primarily via manual flight operation techniques and principles. Such stations are generally minimally automated and are designed to monitor or control only a single aircraft. One approach to this problem is a station capable of monitoring or managing multiple aircraft, but such stations remain capable of managing only a single aircraft at a time (e.g., and shifting this one-to-one relationship between several aircraft as desired). However, this approach may not always provide the operator with the ability to most efficiently switch to an unmanned aircraft in need of immediate attention, nor any way to monitor aircraft that are not under direct control.

SUMMARY

In one aspect, embodiments of the inventive concepts disclosed herein are directed to a station for managing multiple unmanned aircraft. The station includes a data radio, which may be incorporated into the station or shared by multiple stations, for receiving status updates from unmanned aircraft controlled by that particular station (and for sending command and control messages to each controlled aircraft, based on received status updates or other control input). Each station may dedicate processing resources to flight-critical status operations for each of its controlled aircraft. For example, each controlled aircraft is assigned a high assurance router for identifying, from the status data received from its associated aircraft, flight-critical status data and forwarding the flight-critical data to the associated aircraft manager. Each controlled aircraft also has an aircraft manager assigned to it; the aircraft manager generates aircraft-specific status updates based on the received flight-critical status data (e.g., state parameters or graphic elements). Based on the received status data, the aircraft manager may update the alert condition or state for that aircraft (e.g., green/nominal, yellow/caution, red/warning). A display manager synchronizes the status updates received from each aircraft manager and manages a priority queue of all aircraft controlled by that station. For example, aircraft connecting to the station first, aircraft selected by the operator, or in a warning state, may be designated the active aircraft atop the priority queue. A display unit connected to the display manager displays synchronized status information for all aircraft controlled by the station. For example, detailed flight and navigation displays may be provided for the active aircraft, while secondary aircraft of lower priority (e.g., that connected more recently or which have a lower alert condition) may be associated with summary windows providing basic information on the alert condition, position, or heading of the secondary aircraft.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION OF EXEMPLARY EMBODIMENTS

Figure 1:
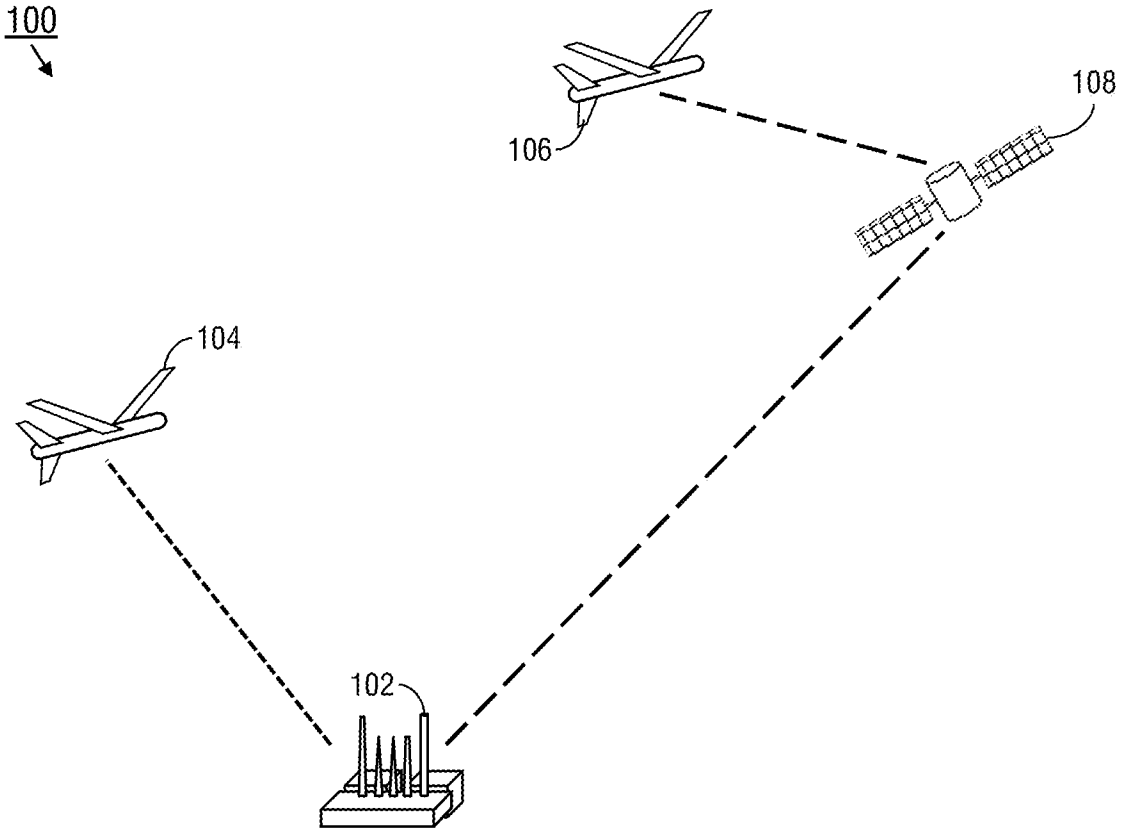
FIG. 1 illustrates an exemplary embodiment of a station for monitoring and managing multiple unmanned aircraft according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a control station capable of simultaneously monitoring and managing multiple unmanned aircraft. The control station may be under the control of a human operator (and capable of accepting control input therefrom for the aircraft under its control), or fully automated. The control station allocates processing and routing resources to each controlled aircraft to ensure accurate, synchronized control data and prioritizes the pool of currently controlled aircraft. Should a fault occur in the control of an unmanned aircraft, the control station can hand off the aircraft to another station without interrupting control operations for other controlled aircraft.

Referring to FIG. 1, an exemplary embodiment of an unmanned aircraft management station 100 (UAMS) according to the inventive concepts disclosed herein may include communications and processing components 102 for simultaneous and high-assurance monitoring and management of multiple unmanned aircraft 104, 106. The unmanned aircraft 104, 106 may include, but is not limited to, fixed-wing aircraft, vertical takeoff and landing (VTOL) aircraft, helicopters or rotary-wing aircraft, while the UAMS 100 may be under the control of one or more human operators or may be fully automated. The UAMS 100 may manage any combination of unmanned aircraft 104 within line of sight (LOS) of the UAMS and unmanned aircraft 106 beyond line of sight (BLOS) of the UAMS. The UAMS 100 may maintain communications with, and control over, the latter BLOS unmanned aircraft 106 via communications satellites (108). The communications and processing components 102 may be co-located within a fixed ground-based facility or aboard a mobile platform, e.g., a land, waterborne, or airborne vehicle. The individual communications and processing components 102 may be remotely located from each other to the extent to which this is practical, e.g., disposed in different areas of the ground-based facility mobile platform.

Figure 2A:
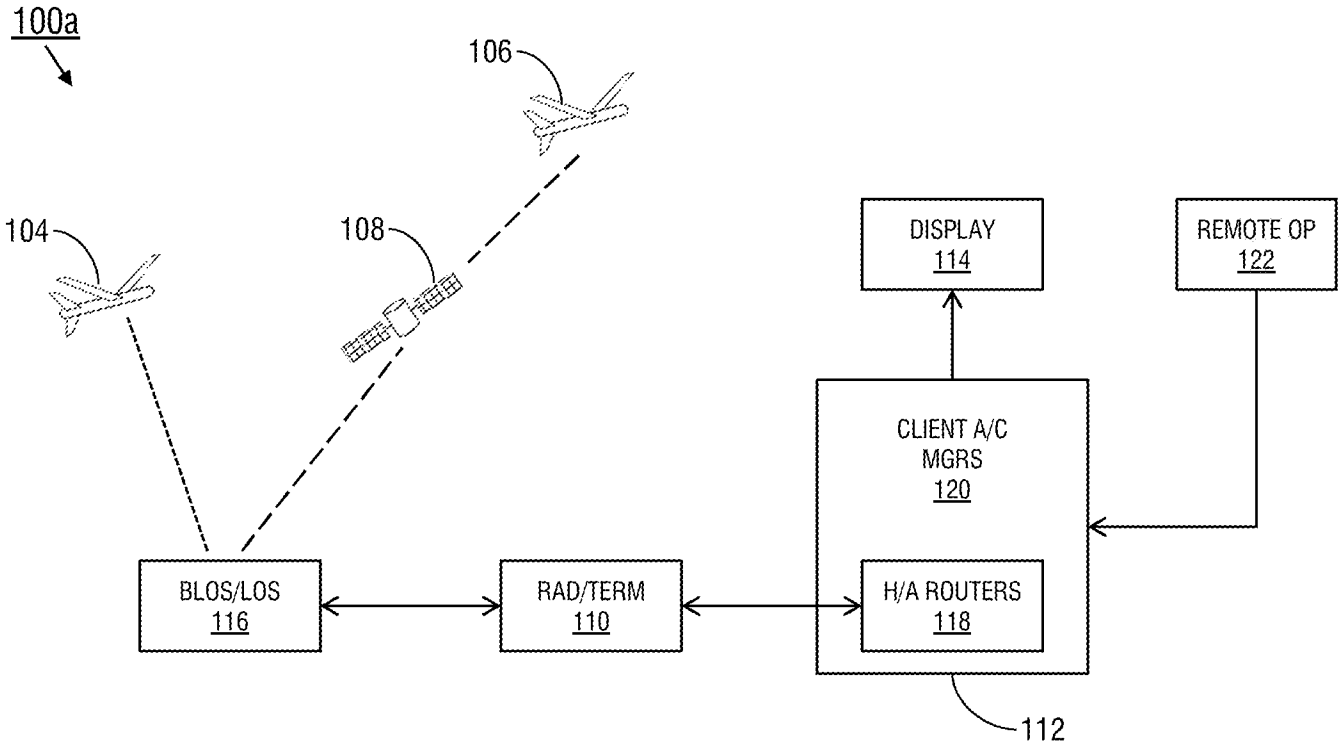
FIGS. 2A and 2B are diagrammatic illustrations of the architecture of the station of FIG. 1.

Referring to FIG. 2A, the UAMS 100*a* may be implemented and may function similarly to the UAMS 100 of FIG. 1, except that the UAMS 100*a* may include radio/terminal components 110, control processors 112, and a display unit 114. For example, the radio/terminal components 110 may include a data radio for maintaining assured communications (via LOS/BLOS antenna elements 116) with LOS unmanned aircraft 104 and BLOS unmanned aircraft 106 (via communications satellites 108). Radio/terminal components 110 may be remotely located from, and networked into, the UAMS 100. The control processors 112 may allocate fixed bandwidths of processing, memory, input/output, and graphics resources for each unmanned aircraft 104, 106 currently under the control of the UAMS 100*a*, e.g., high assurance routers (118) and client aircraft managers (120; e.g., for command/control (C2) operations). For example, each high assurance router 118 may monitor incoming messages received by the radio/terminal components 110 from the unmanned aircraft 104, 106 to which it is allocated. The high assurance router 118 may determine, for example, if the inbound message includes C2 information or flight-critical status data (FCSD) and should therefore use assured bandwidth, e.g., the client aircraft manager 120. The client aircraft managers 120 may generate, based on C2 information and FCSD, state updates for their dedicated unmanned aircraft 104, 106. These state updates may be synchronized by the control processors 112 and presented to a remote operator (122) via the display unit 114 (e.g., via head-down display (HDD), heads-up display (HUD), or head-worn display (HWD)), such that the remote operator maintains a current and accurate indication of all unmanned aircraft 104, 106 under the control of the UAMS 100*a*. Because the control processors 112 allocate dedicated bandwidth (e.g., routers 118 and client aircraft managers 120), state updates from each individual unmanned aircraft 104, 106 may refresh independently of any other client unmanned aircraft under the control of the UAMS 100*a*. Client aircraft managers 120 may generate C2 messages for their dedicated unmanned aircraft 104, 106 (e.g., based on control input provided by the remote operator 122, or in response to received FCSD) and send the C2 messages out to the dedicated unmanned aircraft via the high-assurance router 118.

The display unit 114 may present a visual summary of the synchronized state updates from all controlled aircraft which may include, but is not limited to, aircraft status data, graphical representations of state, intention, or position, and alert conditions as they arise. The UAMS 100*a* may, via the control processors 112, accept control input from the remote operator 122. The control processors 112 may prioritize the pool of unmanned aircraft 104, 106 controlled by the UAMS 100*a*, such that (as shown below) priority aircraft, e.g., those aircraft controlled by the UAMS for the longest duration or those aircraft in a warning state, are prominently presented to the remote operator 122. For example, the display unit 114 may present a primary flight display (PFD) or instrument panel corresponding to a priority unmanned aircraft in a warning state, so that the remote operator 122 may attempt to resolve the warning state via direct control of the priority unmanned aircraft.

Figure 2B:
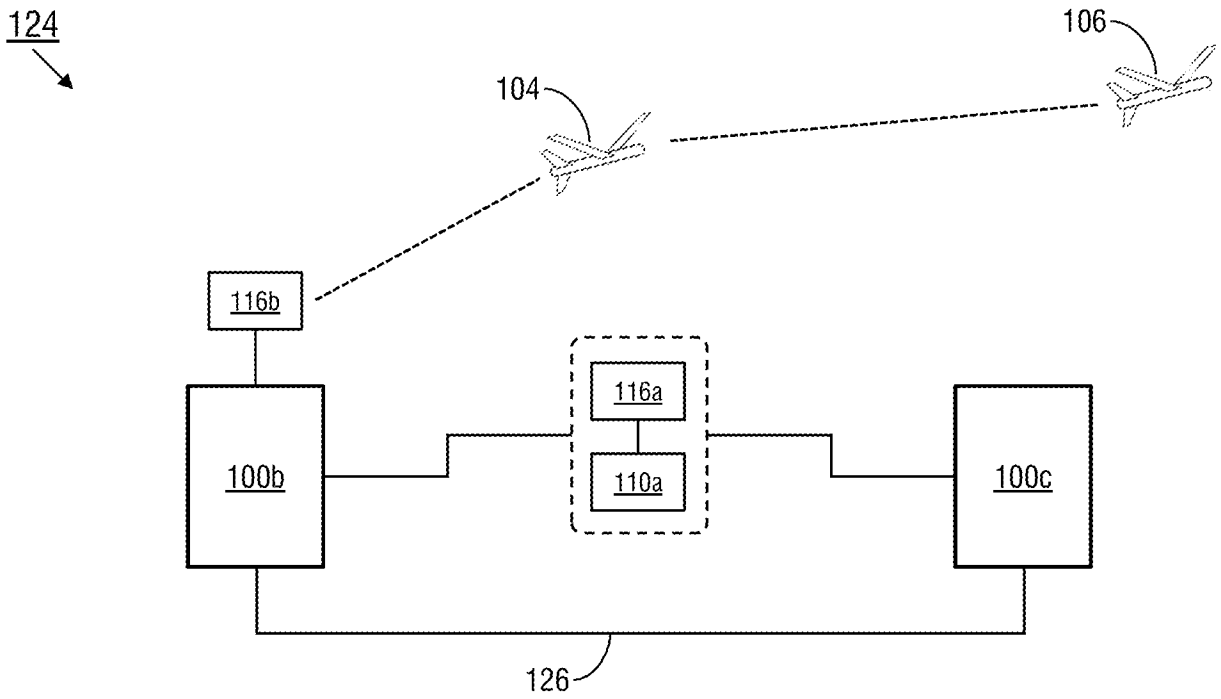

Referring also to FIG. 2B, the UAMS 100*b-c* may be implemented and may function similarly to the UAMS 100*a* of FIG. 2A, except that the UAMS 100*b-c* may be components of a larger network (124) of UAMS interconnected (126) via physical/wired or wireless network links. In some embodiments, components of the UAMS 100*b-c* may be remotely located from other components of the UAMS, or components may be shared between more than one UAMS. For example, the UAMS 100*b-c* may both be linked to shared radio/terminal components (110*a*) and/or shared LOS/BLOS antenna elements (116*a*). The shared radio/terminal components 110*a* and/or shared LOS/BLOS antenna elements 116*a* may receive status updates from aircraft under the control of both UAMS 100*b-c* (and send out C2 messages to controlled aircraft), determining the appropriate destination UAMS for all status updates (and destination aircraft for C2 messages) and forwarding inbound and outbound messages accordingly.

The network 124 of UAMS 100*b-c* may achieve BLOS functionality without the use of BLOS antenna elements (116*a*) or communications satellites (108, FIG. 1). For example, the BLOS unmanned aircraft 106 may be under the control of the UAMS 100*b* but beyond its direct line of sight. However, the UAMS 100*b* may maintain control of the BLOS unmanned aircraft 106 by establishing a network relay link via another LOS aircraft (104) under the control of the UAMS 100*b*. For example, the UAMS 100*b* may receive status updates from, and send C2 messages to, the controlled LOS aircraft 104 via a shared LOS antenna (110*a*) or via its own LOS antenna (116*b*). The UAMS 100*b* may additionally relay C2 messages to the BLOS unmanned aircraft 106, and receive status updates therefrom, via the LOS unmanned aircraft 104.

Figure 3:
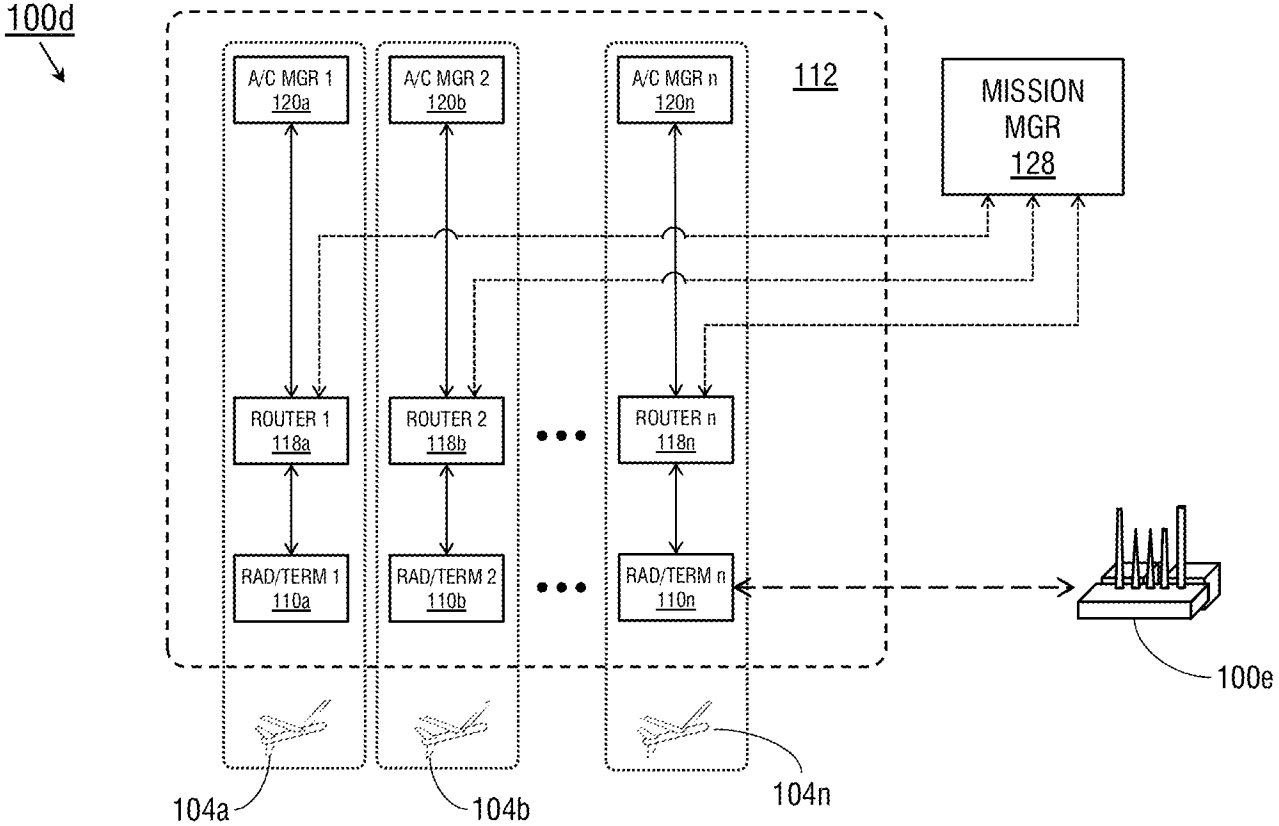
FIG. 3 is a diagrammatic illustration of the architecture of the station of FIG. 1.

Referring to FIG. 3, the UAMS 100*d* may be implemented and may function similarly to the UAMS 100*a-c* of FIGS. 2A and 2B, except that the control processors 112 of the UAMS 100*d* may allocate assured resources to each of n unmanned aircraft 104*a*, 104*b*, . . . 104*n* currently under the control of the UAMS. The n unmanned aircraft 104*a-n* may include either LOS or BLOS unmanned aircraft (104, 106, FIG. 1). Each high assurance router (118*a-n*) allocated to each unmanned aircraft 104*a-n* may provide separation and routing of inbound mission-critical and status messages from its corresponding unmanned aircraft (as well as outbound C2 messages thereto) to identify flight critical status messages, forwarding flight-critical messages to the corresponding client aircraft manager 120*a-n* and mission-critical (e.g., payload-status) messages to a mission management station (128). For example, the high assurance routers 118*a-n* may monitor message headers or identifiers according to NATO STANdardization Agreement (STANAG) 4586, Unmanned Aerospace Systems (UAS) C2 Standard Initiative (UCI), or any other applicable standards and protocols to identify flight-critical status data (FCSD).

The UAMS 100*d* and/or the mission management station 128 may be part of a distributed network of interconnected stations capable of simultaneously managing and monitoring a pool or network of unmanned aircraft including the unmanned aircraft 104*a-n* managed by the UAMS 100*d* as well as other aircraft currently under the control of other UAMS (100*e*). Status updates from within the network of unmanned aircraft 104*a-n* may be shared with additional UAMS 100*e* (e.g., according to network policies and rules) in anticipation of a potential handoff of one or more unmanned aircraft 104*a-n* between the UAMS 100*b* and the UAMS 100*c*.

Figure 4:
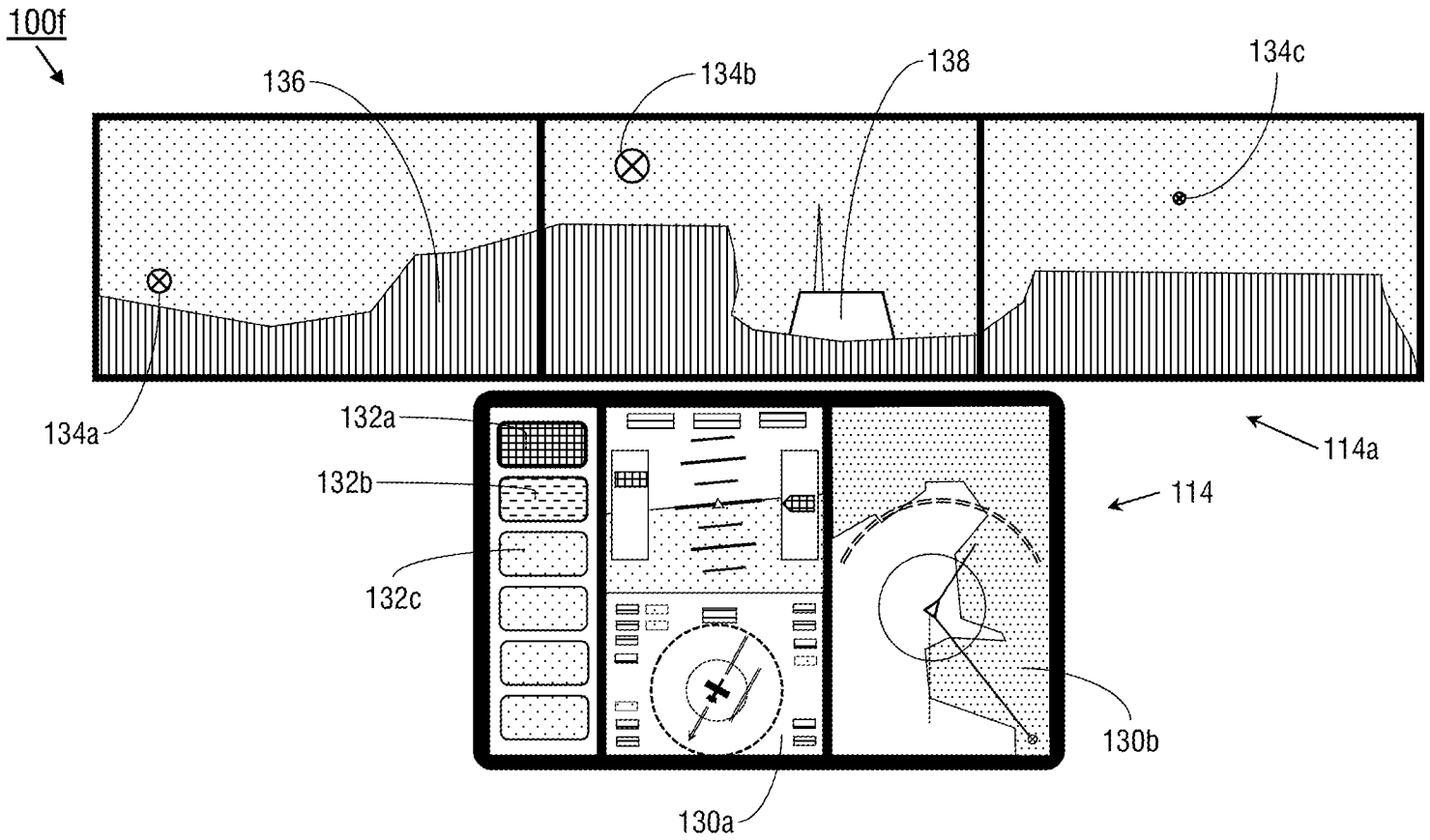
FIG. 4 illustrates a display system of the station of FIG. 1.

Referring to FIG. 4, the UAMS 100*f* may be implemented and may function similarly to the UAMS 100*d-e* of FIG. 3, except that the UAMS 100*f* may include a situational awareness display (114*a*) in addition to the display unit 114. The situational awareness display 114*a* may provide a mission-specific or battle-specific perspective on the pool of unmanned aircraft (104*a-n*, FIG. 3) managed by the UAMS 100*f*. For example, the display unit 114 may include one or more priority displays (130*a-b*) dedicated to a priority unmanned aircraft actively monitored by the UAMS 100*f* and one or more summary windows (132*a-c*) dedicated to secondary unmanned aircraft passively monitored by the UAMS 100*f*. The summary windows 132*a-c* may display, in addition to the secondary aircraft, status data of the priority aircraft. The control processors (112, FIG. 3) may organize the pool of unmanned aircraft 104*a-n* currently under control of the UAMS 100*f* into a queue or similar hierarchy. For example, the pool of unmanned aircraft 104*a-n* may include a single priority unmanned aircraft, all other unmanned aircraft under the control of the UAMS 100*f* being secondary unmanned aircraft. For example, the priority unmanned aircraft may be the aircraft under control of the UAMS 100*f* currently in a warning state (e.g., as opposed to a caution state or a normal state). If no unmanned aircraft 104*a-n* currently under control of the UAMS 100*f* is in a warning state, or if multiple unmanned aircraft 104*a-n* are in a warning state, arbitration of the priority unmanned aircraft may be achieved according to predetermined policies and rules (e.g., the first unmanned aircraft to come under the control of the UAMS 100*f*), according to exterior conditions (e.g., equipment status, flight boundaries, fuel levels, weather/atmospheric conditions), or the priority unmanned aircraft may be manually selected by the remote operator (122, FIG. 2), e.g., in order to send control input for execution by the selected unmanned aircraft. Similarly, the remote operator 122 may manually select any of the unmanned aircraft 104*a-n* as the priority unmanned aircraft as needed, regardless of the state of the priority queue or of any individual aircraft.

The priority displays 130*a-b* may include a primary flight display (PFD), flight instruments (130*a*), navigational displays (130*b*), synthetic vision displays, aircraft parameters, or onboard camera feeds corresponding to the current priority unmanned aircraft. The navigational display 130*b* may include the positions of secondary unmanned aircraft if applicable. The summary windows 132*a-c* may include minimal aircraft parameters as well as color-coded indicators to show at a glance the overall status or condition of each secondary (or priority) unmanned aircraft. For example, the summary window 132*a* may be colored or outlined in red to indicate an unmanned aircraft in an alert condition; the summary window 132*b* may be colored or outlined in yellow to indicate an unmanned aircraft in a caution condition; and the summary window 132*c* may be colored or outlined in green to indicate an unmanned aircraft in a normal condition. The priority queue of unmanned aircraft, and thus the priority displays 130*a-b* and summary windows 132*a-c*, may update as new status updates are received by the UAMS 100*f* from each of the unmanned aircraft 104*a-n* (and as the parameters and conditions of each unmanned aircraft consequently update). In some embodiments, the UAMS 100*f* may present status updates from its controlled aircraft in nonvisual media, e.g., via aural notifications of changes to an alert condition, state, or position.

The situational awareness display 114*a* may be switchable between two-dimensional (2D) and three-dimensional (3D) views, and may show the positions 134*a-c* of one or more of the unmanned aircraft 104*a-n* under control of the UAMS 100*f* relative to natural features (136), manmade features (138), and other georeferenced land, airborne, or maritime objects. The situational awareness display 114*a* may incorporate networked information (e.g., from a distributed network (124, FIG. 2B) of UAMS including the UAMS 100*f*) and georeferenced sensor information from the unmanned aircraft 104*a-c* to construct a composite picture for display.

Figure 5:
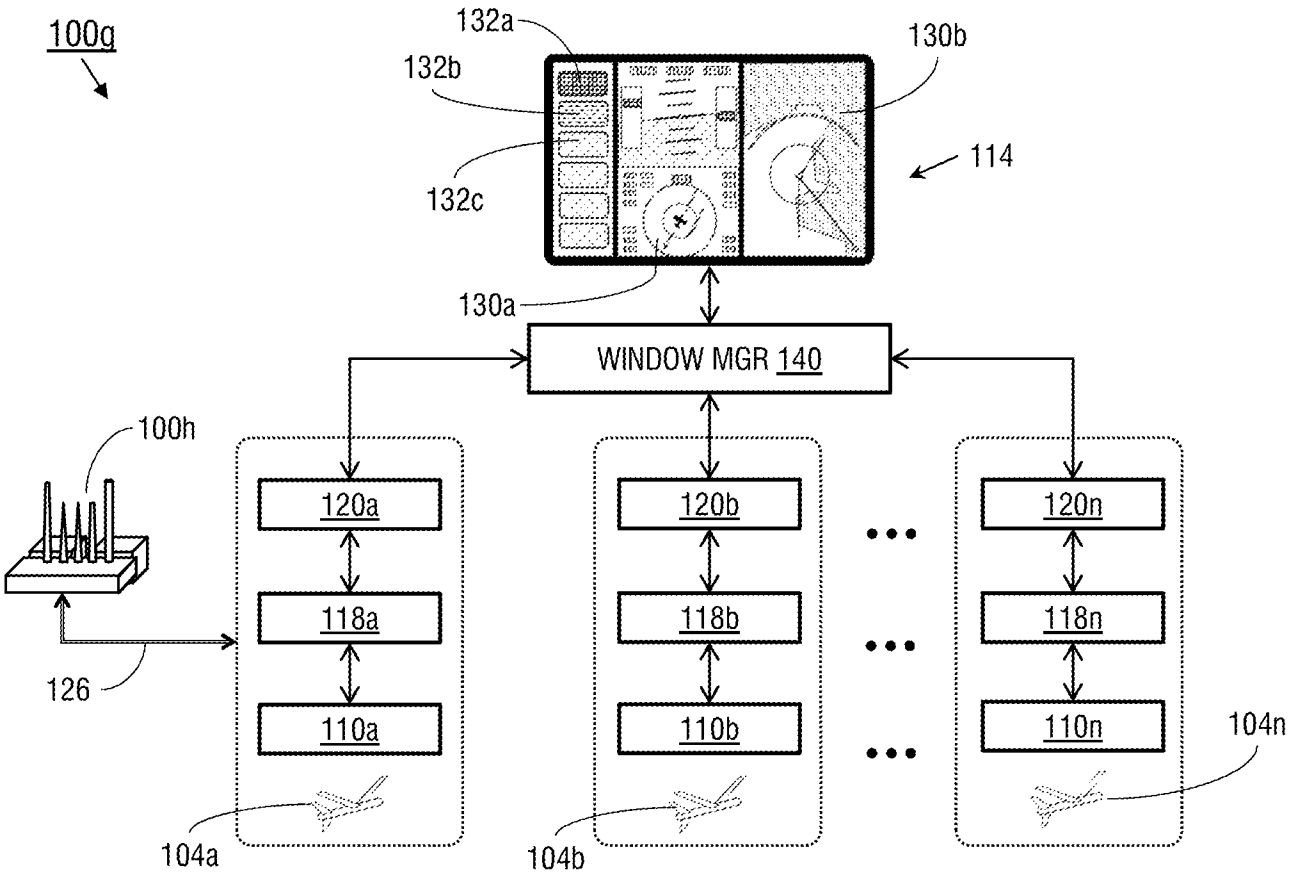
FIG. 5 is a diagrammatic illustration of the architecture of the station of FIG. 1.

Referring to FIG. 5, the UAMS 100*g* may be implemented and may function similarly to the UAMS 100*f* of FIG. 4, except that the UAMS 100*g* may incorporate a window manager (140; e.g., station manager, display manager) for management of the priority queue corresponding to the unmanned aircraft 104*a-n* currently under the control of the UAMS 100*g*. For example, the window manager 140 may receive, and synchronize, flight-critical status updates received from each client aircraft manager 120*a-n*, such that all updates to the flight-critical status data displayed by the display unit 114 accurately reflect the positions and states of the unmanned aircraft 104*a-n*. For example, based on received status updates (e.g., including any changes to the condition of an unmanned aircraft 104*a-n*), the window manager 140 may reorganize the priority queue and enforce which client aircraft managers 120*a-n* are drawing to the priority displays 130*a-b* (e.g., the designated priority unmanned aircraft) as opposed to the summary windows 132*a-c* (e.g., the secondary unmanned aircraft). If the UAMS 100*g* is configured to accept flight control input from the remote operator (122, FIG. 2), the window manager 140 may handle the forwarding of said flight control input to the appropriate client aircraft manager 120*a-n*, so that the appropriate C2 messages may be forwarded to the corresponding unmanned aircraft 104*a-n* (e.g., the current priority unmanned aircraft) via the appropriate routers 118*a-n* and radio/terminal components 110*a-n*.

In some embodiments, the window manager 140 may control the handoff of an unmanned aircraft 104*a-n* under the control of the UAMS 100*e* to another UAMS (100*h*). For example, if the unmanned aircraft 104*a* fails to update its status data in a timely fashion, or leaves a geographical area assigned to the UAMS 100*g* for an area assigned to the UAMS 100*h*, or the remote operator 122 so elects, control of the unmanned aircraft 104*a* may be transferred or "handed off" from the UAMS 100*g* to the UAMS 100*h* via network link (126) between the transferring and receiving UAMS. Handoff or transfer of an unmanned aircraft 104*a* may be initiated automatically or manually, e.g., by the remote operator 122. The network link 126 between the UAMS 100*g-h* may be physical or wireless. The window manager 140 may provide advisories to the remote operators 122 of both the transferring UAMS 100*g* and the receiving UAMS 100*h*, such that each remote operator understands at all times which unmanned aircraft 104*a-n* are under their control at a given time, and are adequately advised as to when the transfer of control will commence and has completed. The window manager 140 of the UAMS 100*g* may advise a counterpart window manager of the UAMS 100*h* to allocate processing resources from the control processors (112, FIG. 2) such that, e.g., the high assurance routers 118*a* and client aircraft managers 120*a* are replicated at the UAMS 100*h* to provide a seamless transfer of control.

Figure 6:
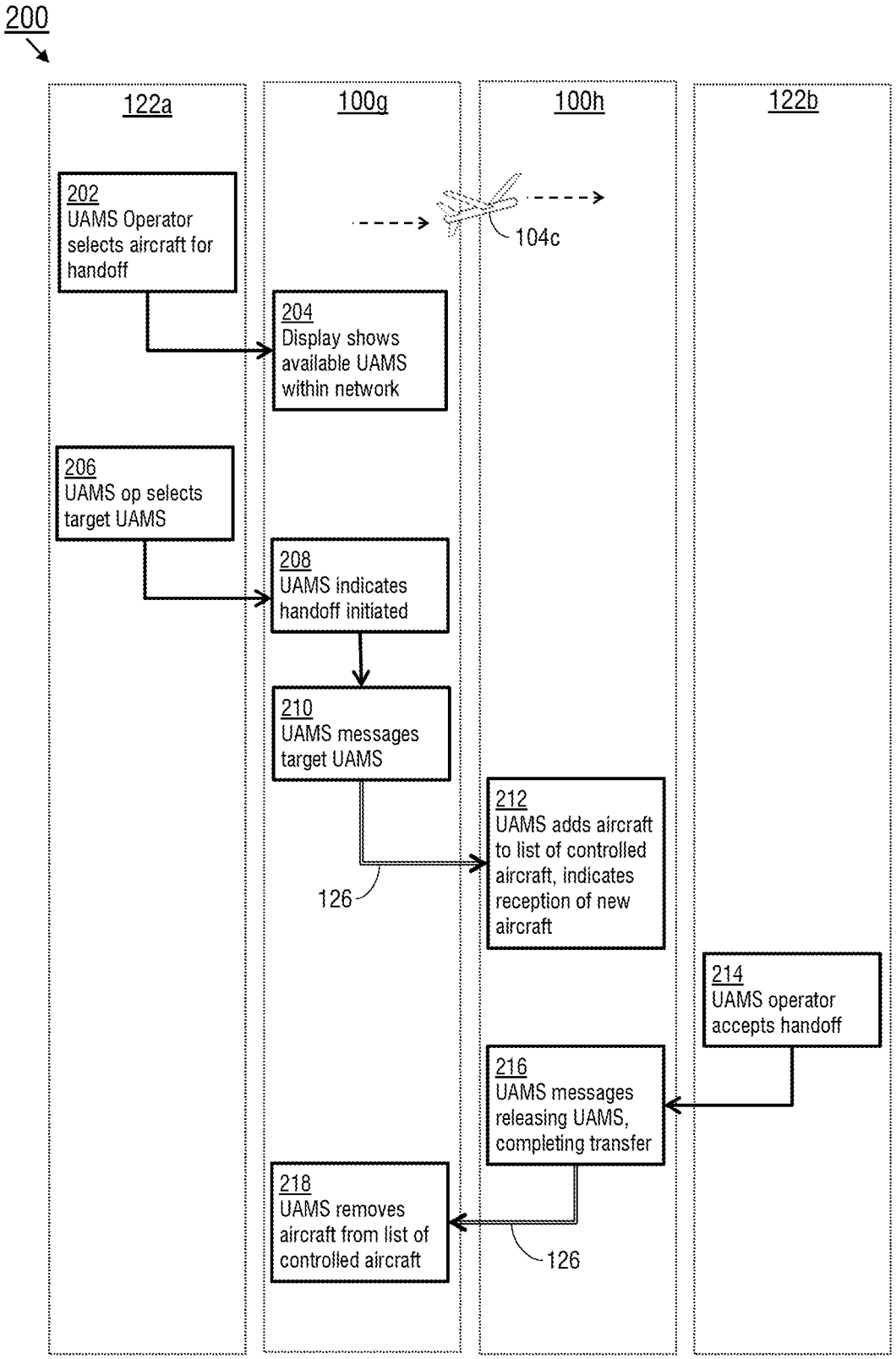
FIG. 6 illustrates an exemplary embodiment of a method according to the inventive concepts disclosed herein.

Referring now to FIG. 6, an exemplary embodiment of a method 200 for handing off, or transferring, control of an unmanned aircraft (104*a-n*, FIG. 5 according to the inventive concepts disclosed herein may be implemented by the UAMS 100*g-h* (and, if applicable, by their respective remote operators 122*a-b*) in some embodiments, and may include one or more of the following steps. (In some embodiments, the UAMS 100*g-h*, and thus implementation of the method 200, may be fully automated.)

At a step 202, the remote operator 122*a* of the transferring UAMS 100*g* selects an unmanned aircraft 104*c* to be handed off to the receiving UAMS 100*h*. Alternatively, the selection of the unmanned aircraft 104*c* may be automatically determined, e.g., by a fault associated with the unmanned aircraft.

At a step 204, the transferring UAMS 100*g* (e.g., via its display unit 114, FIG. 2) presents a menu of candidate UAMS within the distributed network to which the transferring UAMS 100*g* belongs, the candidate UAMS available to receive control of the unmanned aircraft 104*c*.

At a step 206, the remote operator 122*a* selects the receiving UAMS 100*h* from the displayed menu of candidate UAMS.

At a step 208, the transferring UAMS 100*g* (e.g., via its display unit 114) may indicate (e.g., via visual, aural, haptic, or tactile means) to its remote operator 122*a* that the handoff process has been initiated by the selection of the receiving UAMS 100*h*.

At a step 210, the transferring UAMS 100*g* (e.g., via the client aircraft manager 120 and network link 126) may send messages to the receiving UAMS 100*h* concerning initiation of the handoff process.

At a step 212, the receiving UAMS 100*h* indicates to its remote operator 122*b* the reception of the unmanned aircraft 104*c* and adds the unmanned aircraft 104*c* to its pool of controlled aircraft. The receiving UAMS 100*h* may also, through its control processors 112 (FIG. 2), allocate dedicated processing resources such as a high assurance router 118 and a client aircraft manager 120 to the unmanned aircraft 104*c*.

At a step 214, the receiving UAMS 100*h* (or its remote operator 122*b*) accepts the transfer of the unmanned aircraft 104*c* to its control.

At a step 216, the receiving UAMS 100*h* sends messages to the transferring UAMS 100*g* (via the network link 126) acknowledging control of the unmanned aircraft 104*c* and releasing the transferring UAMS from control of the unmanned vehicle.

At a step 218, the transferring UAMS 100*g* removes the transferred unmanned aircraft 104*c* from its pool of currently controlled unmanned aircraft. The transferring UAMS 100*g* may additionally (e.g., via its control processors 112) deallocate processing resources (e.g., radio/terminal components 110, high assurance router 118, and client aircraft manager 120) formerly dedicated to the transferred unmanned aircraft 104*c*.

As will be appreciated from the above, systems and methods according to embodiments of the inventive concepts disclosed herein may provide for the simultaneous management of multiple unmanned aircraft by providing synchronized updates on the states and conditions of unmanned aircraft to their controlling stations. Further, control of one or more unmanned aircraft can be seamlessly transferred between stations in a distributed network, such that every unmanned aircraft is always under the control of a station and every station (and/or its operator) is always aware of the aircraft under its control.

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

We claim:

1. A station for managing multiple unmanned aircraft, comprising:

a data radio configured to:

receive one or more command and control (C2) messages from at least one unmanned aircraft controlled by the station;

and allocate a unique high assurance router from one or more high assurance routers associated with the station to each aircraft of the at least one controlled unmanned aircraft, each high assurance router associated with a dedicated bandwidth and including an aircraft manager;

each high assurance router configured to:

(1) receive from the data radio the one or more C2 messages corresponding to its controlled unmanned aircraft;

(2) determine whether each C2 message is a flight-critical C2 message or a payload status C2 message;

(3) forward each flight-critical C2 message to the corresponding aircraft manager;

and (4) forward each payload status C2 message to a mission manager shared by the at least one controlled unmanned aircraft;

each aircraft manager configured to, independently of every other aircraft manager, update status data of, and control flight operations of, its controlled unmanned aircraft based on the at least one flight-critical C2 message;

a display manager coupled to the at least one aircraft manager and configured to:

(1) synchronize the updated status data of each controlled unmanned aircraft;

and (2) generate at least one priority queue based on the synchronized updated state of the at least one unmanned aircraft, the priority queue comprising an actively monitored aircraft and at least one passively monitored aircraft;

and at least one display unit coupled to the display manager and configured to display:

a primary flight display (PFD) corresponding to, and configured for direct control of, the actively monitored aircraft;

and at least one summary window corresponding to the synchronized updated status data of each passively monitored aircraft.

2. The station of claim 1, further comprising:

at least one antenna element coupled to the data radio, the antenna element including at least one of a line-of-sight (LOS) antenna and a beyond-line-of-sight (BLOS) antenna associated with at least one communications satellite.

3. The station of claim 2, wherein the at least one unmanned aircraft includes:

at least one first unmanned aircraft configured to send first status data to the data radio via a first network link to the LOS antenna;

and at least one second unmanned aircraft beyond a LOS of the station, the second unmanned aircraft configured to relay second status data to the data radio via a second network link to the first unmanned aircraft.

4. The station of claim 1, wherein:

the at least one updated status data includes at least one alert condition selected from a group including a normal condition, a caution condition, or a warning condition;

and the actively monitored aircraft is associated with the at least one alert condition.

5. The station of claim 1, wherein:

the display unit is configured to accept control input from a user;

and each aircraft manager is selected from:

a first aircraft manager configured to 1) generate a first outbound C2 message based on the control input and 2) send the first outbound C2 message to the actively monitored aircraft via the corresponding router;

or a second aircraft manager configured to 1) generate a second outbound C2 message based on the control input and 2) send the second outbound C2 message to the passively monitored aircraft via the corresponding router.

6. The station of claim 1, wherein the actively monitored aircraft is selectable by the user from the at least one unmanned aircraft.

7. The station of claim 1, wherein the display unit is embodied in at least one of a heads-down display (HDD), a heads-up display (HUD) or a head-worn display (HWD) worn by the user.

8. The station of claim 1, wherein the PFD includes at least one of a navigational display or an instrument panel of the active aircraft.

9. The station of claim 1, wherein the status data includes at least one of a status indicator corresponding to the synchronized updated status data, an aircraft identifier, an aircraft status, position data, fuel data, or propulsion data.

10. The station of claim 1, wherein the display unit further comprises:

at least one situational awareness display configured to display one or more images associated with a position of the at least one unmanned aircraft relative to one or more of a natural feature, a manmade feature, or a georeferenced object.

11. The station of claim 10, wherein the one or more displayed images include georeferenced sensor information corresponding to the at least one unmanned aircraft and received by the data radio.

12. The station of claim 10, wherein the one or more displayed images include one or more of a two-dimensional image or a three-dimensional image.

13. The station of claim 1, wherein the station is embodied in a mobile platform.

14. The station of claim 1, wherein the station is a transferring station and:

the at least one unmanned aircraft includes at least one outbound aircraft associated with an allocated high assurance router;

the display unit is configured to:

display a list of one or more candidate stations;

and display at least one first indicator associated with a transfer of the outbound aircraft to a receiving station of the one or more candidate stations;

and the display manager is configured to:

transmit at least one initiation message to the receiving station, the initiation message associated with initiating the transfer;

receive at least one acceptance message from the receiving station, the acceptance message associated with accepting the transfer;

and upon receiving the acceptance message, 1) remove the outbound aircraft from the at least one unmanned aircraft and 2) deallocate the high assurance router of the outbound aircraft.

15. The station of claim 1, wherein the station is a receiving station and:

the at least one unmanned aircraft includes at least one inbound aircraft;

the display manager is configured to:

receive at least one initiation message from a transferring station, the initiation message associated with initiating a transfer of the inbound aircraft from the transferring station;

accept the transfer by allocating a high assurance router to the inbound aircraft;

and send at least one acceptance message to the transferring station, the acceptance message indicating acceptance of the transfer;

and the display unit is configured to:

display at least one indicator associated with the transfer.

16. The station of claim 1, wherein the station is a first station of a network and:

the first station is communicatively coupled to at least one second station of the network via at least one network link, the first station corresponding to one or more first controlled unmanned aircraft and the at least one second station corresponding to one or more second controlled unmanned aircraft;

the first station and the at least one second station configured to share one or more of:

a line-of-sight (LOS) antenna;

a beyond line-of-sight (BLOS) antenna associated with at least one communications satellite;

and the data radio.

* * * * *